US010276978B2

(12) United States Patent
Whitehead et al.

(10) Patent No.: US 10,276,978 B2
(45) Date of Patent: Apr. 30, 2019

(54) RUGGEDIZED USB CONNECTOR

(71) Applicant: Cubic Corporation, San Diego, CA (US)

(72) Inventors: Clayton Whitehead, Croydon (GB); Ayo Adigun, Kent (GB)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 16/025,759

(22) Filed: Jul. 2, 2018

(65) Prior Publication Data

US 2019/0020150 A1 Jan. 17, 2019

Related U.S. Application Data

(60) Provisional application No. 62/531,266, filed on Jul. 11, 2017.

(51) Int. Cl.
*H01R 13/62* (2006.01)
*H01R 13/639* (2006.01)
(Continued)

(52) U.S. Cl.
CPC ..... *H01R 13/639* (2013.01); *H01R 13/6273* (2013.01); *H01R 13/6275* (2013.01);
(Continued)

(58) Field of Classification Search
CPC ..... H01R 13/6275; H01R 13/6582; H01R 13/6272
(Continued)

(56) References Cited

U.S. PATENT DOCUMENTS 6,394,842 B1 * 5/2002 Sakurai ..... H01R 13/6583 439/607.25
7,192,295 B1 3/2007 Yeh
(Continued)

FOREIGN PATENT DOCUMENTS

WO 2016-103363 A1 6/2016

OTHER PUBLICATIONS

International Search Report and Written Opinion dated Oct. 1, 2018 for International Patent Application No. PCT/US2018/041001, all pages.

*Primary Examiner* — Hae Moon Hyeon
(74) *Attorney, Agent, or Firm* — Kilpatrick Townsend & Stockton

(57) ABSTRACT

An electrical connector assembly comprising a plug assembly and a receptacle assembly. The plug assembly includes a plug housing including a latch release configured to slide in a longitudinal direction. The plug assembly also includes an inserting portion coupled to the plug housing including a first aperture positioned on a first lateral side and a second aperture positioned on a second lateral side. The plug assembly further includes a first latch being elongated, coupled to the latch release, and at least partially extending in the longitudinal direction through an interior of the inserting portion and a second latch being elongated, coupled to the latch release, and at least partially extending in the longitudinal direction through the interior of the inserting portion. The receptacle assembly is configured to at least partially receive the plug assembly.

8 Claims, 8 Drawing Sheets

(51) Int. Cl.

| | |
|---|---|
| ***H01R 13/627*** | (2006.01) |
| *H01R 107/00* | (2006.01) |
| *H01R 24/64* | (2011.01) |
| *H01R 24/60* | (2011.01) |

(52) U.S. Cl.
CPC ..... *H01R 24/60* (2013.01); *H01R 24/64* (2013.01); *H01R 2107/00* (2013.01)

(58) Field of Classification Search
USPC ..... 439/153, 353
See application file for complete search history.

(56) References Cited

U.S. PATENT DOCUMENTS

| | | | | |
|---|---|---|---|---|
| 7,455,545 | B2 * | 11/2008 | Chawgo | H01R 13/6275 439/352 |
| 8,794,992 | B2 * | 8/2014 | Hsu | H01R 13/5213 439/353 |
| 9,843,133 | B2 * | 12/2017 | Kashani | H01R 13/6275 |
| 2005/0245132 | A1 | 11/2005 | Huang et al. | |
| 2007/0004265 | A1 * | 1/2007 | Yeh | H01R 13/6397 439/358 |
| 2007/0049100 | A1 * | 3/2007 | Tsai | H01R 13/6275 439/352 |
| 2015/0236446 | A1 * | 8/2015 | Kashani | H01R 13/6275 439/270 |

* cited by examiner

400

RUGGEDIZED USB CONNECTOR

CROSS-REFERENCES TO RELATED APPLICATIONS

This Application claims priority to U.S. Provisional Patent Application No. 62/531,266 filed Jul. 11, 2017 titled "RUGGEDIZED USB CONNECTORS", the entire disclosure of which is hereby incorporated by reference, for all purposes, as if fully set forth herein.

BACKGROUND OF THE INVENTION

Universal serial bus (USB) is an industry standard that defines cables, connectors, and protocols for connection, communication, and power supply between computing devices and their peripherals. Currently available peripherals that utilize USB include, but are not limited to: mice, joysticks, printers, scanners, digital cameras, webcams, modems, speakers, telephones, smartphones, storage devices, and network connections. Since the original USB 1.0 specification was introduced in January 1996, USB has grown in popularity and has largely replaced interfaces such as serial ports, parallel ports, and the various ad-hoc proprietary interfaces. For the user of a computing device, the USB standard has improved ease of use in several ways. First, the USB interface is self-configuring, so the user does not need to adjust settings such as speed or data format on the computing device or on the USB interface. Second, USB connectors can be standardized and integrated with the computing device so that any peripheral can use any available socket. Third, the USB interface can immediately be used upon connecting the peripheral, without requiring the computing device to be rebooted.

Some limitations of the USB standard relate to the currently available hardware components used to form a USB connection. In many instances, connectors lack the structure necessary to form a secure connection that can withstand pulling forces or torques due to movement of the peripheral device. Failure to retain a secure connection results in termination of the communication between the devices, and may further result in physical damage to one or more of the components. Accordingly, there is a need for new USB connectors capable of retaining a secure connection in response to applied forces and torques to the connector.

BRIEF SUMMARY OF THE INVENTION

Examples given below provide a summary of the present invention. As used below, any reference to a series of examples is to be understood as a reference to each of those examples disjunctively (e.g., "Examples 1-4" is to be understood as "Examples 1, 2, 3, or 4").

Example 1 is an electrical connector assembly comprising: a plug assembly comprising: a plug housing coupled to an electrical wire on a first end, the plug housing including a latch release configured to slide in both a first longitudinal direction and a second longitudinal direction with respect to the plug assembly, the latch release being physically accessible to a user; an inserting portion coupled to a second end of the plug housing, the inserting portion comprising; a first aperture positioned on a first lateral side of the inserting portion; and a second aperture positioned on a second lateral side of the inserting portion, the second lateral side being diametrically opposite the first lateral side; a first latch being elongated, coupled to the latch release, and at least partially extending in the first longitudinal direction through an interior of the inserting portion; and a second latch being elongated, coupled to the latch release, and at least partially extending in the first longitudinal direction through the interior of the inserting portion; and a receptacle assembly configured to at least partially receive the plug assembly, the receptacle assembly comprising: a receptacle housing having a cavity for receiving the inserting portion, a first locking portion for receiving the first latch, and a second locking portion for receiving the second latch; wherein moving the latch release in the first longitudinal direction causes a distal end of the first latch to pass through the first aperture and enter the first locking portion, and a distal end of the second latch to pass through the second aperture and enter the second locking portion; wherein moving the latch release in the second longitudinal direction causes the distal end of the first latch to pass through the first aperture and exit the first locking portion, and the distal end of the second latch to pass through the second aperture and exit the second locking portion.

Example 2 is the electrical connector assembly of example(s) 1, wherein: the distal end of the first latch includes a first hooked portion that points at least partially in the second longitudinal direction; and the distal end of the second latch includes a second hooked portion that points at least partially in the second longitudinal direction.

Example 3 is the electrical connector assembly of example(s) 1-2, wherein: the first locking portion is defined by a first notch extending in the first longitudinal direction, wherein the first notch is configured to interface with the first hooked portion when the electrical connector assembly is in a locked state; and the second locking portion is defined by a second notch extending in the first longitudinal direction, wherein the second notch is configured to interface with the second hooked portion when the electrical connector assembly is in the locked state.

Example 4 is the electrical connector assembly of example(s) 1-3, wherein: the distal end of the first latch includes a first hooked portion that points in a first lateral direction; and the distal end of the second latch includes a second hooked portion that points in a second lateral direction, the second lateral direction being diametrically opposite the first lateral direction.

Example 5 is the electrical connector assembly of example(s) 1-4, wherein: the first notch is defined by a first flat side and a second flat side, wherein the first hooked portion is configured to interface with the first flat side and the second flat side when the electrical connector assembly is in a locked state; and the second notch is defined by a third flat side and a fourth flat side, wherein the second hooked portion is configured to interface with the third flat side and the fourth flat side when the electrical connector assembly is in the locked state.

Example 6 is the electrical connector assembly of example(s) 1-5, wherein the first latch and the second latch are flexible.

Example 7 is the electrical connector assembly of example(s) 1-6, wherein moving the latch release in the second longitudinal direction causes the first latch to bend against the first aperture and the second latch to bend against the second aperture.

Example 8 is the electrical connector assembly of example(s) 1-7, wherein the first latch and the second latch are made from a non-conductive material.

Example 9 is a plug assembly comprising: a plug housing coupled to an electrical wire on a first end, the plug housing including a latch release configured to slide in both a first longitudinal direction and a second longitudinal direction with respect to the plug assembly, the latch release being physically accessible to a user; an inserting portion coupled to a second end of the plug housing, the inserting portion comprising; a first aperture positioned on a first lateral side of the inserting portion; and a second aperture positioned on a second lateral side of the inserting portion, the second lateral side being diametrically opposite the first lateral side; a first latch being elongated, coupled to the latch release, and at least partially extending in the first longitudinal direction through an interior of the inserting portion; and a second latch being elongated, coupled to the latch release, and at least partially extending in the first longitudinal direction through the interior of the inserting portion; and wherein a receptacle assembly is configured to at least partially receive the plug assembly, the receptacle assembly comprising a receptacle housing having a cavity for receiving the inserting portion, a first locking portion for receiving the first latch, and a second locking portion for receiving the second latch; wherein moving the latch release in the first longitudinal direction causes a distal end of the first latch to pass through the first aperture and enter the first locking portion, and a distal end of the second latch to pass through the second aperture and enter the second locking portion; wherein moving the latch release in the second longitudinal direction causes the distal end of the first latch to pass through the first aperture and exit the first locking portion, and the distal end of the second latch to pass through the second aperture and exit the second locking portion.

Example 10 is the plug assembly of example(s) 9, wherein: the distal end of the first latch includes a first hooked portion that points at least partially in the second longitudinal direction; and the distal end of the second latch includes a second hooked portion that points at least partially in the second longitudinal direction.

Example 11 is the plug assembly of example(s) 9-10, wherein: the first locking portion is defined by a first notch extending in the first longitudinal direction, wherein the first notch is configured to interface with the first hooked portion when the electrical connector assembly is in a locked state; and the second locking portion is defined by a second notch extending in the first longitudinal direction, wherein the second notch is configured to interface with the second hooked portion when the electrical connector assembly is in the locked state.

Example 12 is the plug assembly of example(s) 9-11, wherein: the distal end of the first latch includes a first hooked portion that points in a first lateral direction; and the distal end of the second latch includes a second hooked portion that points in a second lateral direction, the second lateral direction being diametrically opposite the first lateral direction.

Example 13 is the plug assembly of example(s) 9-12, wherein: the first notch is defined by a first flat side and a second flat side, wherein the first hooked portion is configured to interface with the first flat side and the second flat side when the electrical connector assembly is in a locked state; and the second notch is defined by a third flat side and a fourth flat side, wherein the second hooked portion is configured to interface with the third flat side and the fourth flat side when the electrical connector assembly is in the locked state.

Example 14 is the plug assembly of example(s) 9-13, wherein the first latch and the second latch are flexible.

Example 15 is the plug assembly of example(s) 9-14, wherein moving the latch release in the second longitudinal direction causes the first latch to bend against the first aperture and the second latch to bend against the second aperture.

Example 16 is the plug assembly of example(s) 9-15, wherein the first latch and the second latch are made from a non-conductive material.

Example 17 is a receptacle assembly comprising: a receptacle housing having a cavity for receiving an inserting portion of a plug assembly; a first locking portion for receiving a first latch of the plug assembly; and a second locking portion for receiving a second latch of the plug assembly; wherein the plug assembly comprises: a plug housing coupled to an electrical wire on a first end, the plug housing including a latch release configured to slide in both a first longitudinal direction and a second longitudinal direction with respect to the plug assembly, the latch release being physically accessible to a user; an inserting portion coupled to a second end of the plug housing, the inserting portion comprising; a first aperture positioned on a first lateral side of the inserting portion; and a second aperture positioned on a second lateral side of the inserting portion, the second lateral side being diametrically opposite the first lateral side; the first latch being elongated, coupled to the latch release, and at least partially extending in the first longitudinal direction through an interior of the inserting portion; and the second latch being elongated, coupled to the latch release, and at least partially extending in the first longitudinal direction through the interior of the inserting portion; wherein moving the latch release in the first longitudinal direction causes a distal end of the first latch to pass through the first aperture and enter the first locking portion, and a distal end of the second latch to pass through the second aperture and enter the second locking portion; wherein moving the latch release in the second longitudinal direction causes the distal end of the first latch to pass through the first aperture and exit the first locking portion, and the distal end of the second latch to pass through the second aperture and exit the second locking portion.

Example 18 is the receptacle assembly of example(s) 17, wherein: the distal end of the first latch includes a first hooked portion that points at least partially in the second longitudinal direction; and the distal end of the second latch includes a second hooked portion that points at least partially in the second longitudinal direction.

Example 19 is the receptacle assembly of example(s) 17-18, wherein: the first locking portion is defined by a first notch extending in the first longitudinal direction, wherein the first notch is configured to interface with the first hooked portion when the electrical connector assembly is in a locked state; and the second locking portion is defined by a second notch extending in the first longitudinal direction, wherein the second notch is configured to interface with the second hooked portion when the electrical connector assembly is in the locked state.

Example 20 is the receptacle assembly of example(s) 17-19, wherein: the distal end of the first latch includes a first hooked portion that points in a first lateral direction; and the distal end of the second latch includes a second hooked portion that points in a second lateral direction, the second lateral direction being diametrically opposite the first lateral direction.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced.

In the appended figures, similar components and/or features may have the same numerical reference label. Further, various components of the same type may be distinguished by following the reference label by a dash followed by a second numerical reference label that distinguishes among the similar components and/or features. If only the first numerical reference label is used in the specification, the description is applicable to any one of the similar components and/or features having the same first numerical reference label irrespective of the suffix.

DETAILED DESCRIPTION OF THE INVENTION

Universal serial bus (USB) connectors come in a variety of different types, including but not limited to: type-A, type-A superspeed, type-B, type-B superspeed, mini-A, mini-B, micro-A, micro-B, micro-B superspeed, and type-C. The most commonly used and most recognizable connectors are the type-A plug and receptacle, in which the type-A plug is characterized by an elongated rectangular cross-section and in which the type-A plug sends and/or receives both power and data to and/or from the type-A receptacle. The type-A USB connection uses four pins that connect to four shielded wires in each of the type-A plug and the type-A receptacle. Two of the four pins are for power (+5V and ground) and the other two pins are for differential data signals (data + and data −).

Currently available USB connectors (type-A, type-B, mini, micro, etc.) currently do not offer a mechanical means of securing the connection/mating between the plug and the receptacle, which can be problematic in various applications. Embodiments of the invention described herein provide a more ruggedized arrangement to allow for the mating halves of the electrical connector assembly (i.e., a plug assembly and a receptacle assembly) to remain coupled to each other in high vibration environments, such as certain military and commercial applications, thus preventing unwanted disconnections and intermittent connections.

Figure 1A:
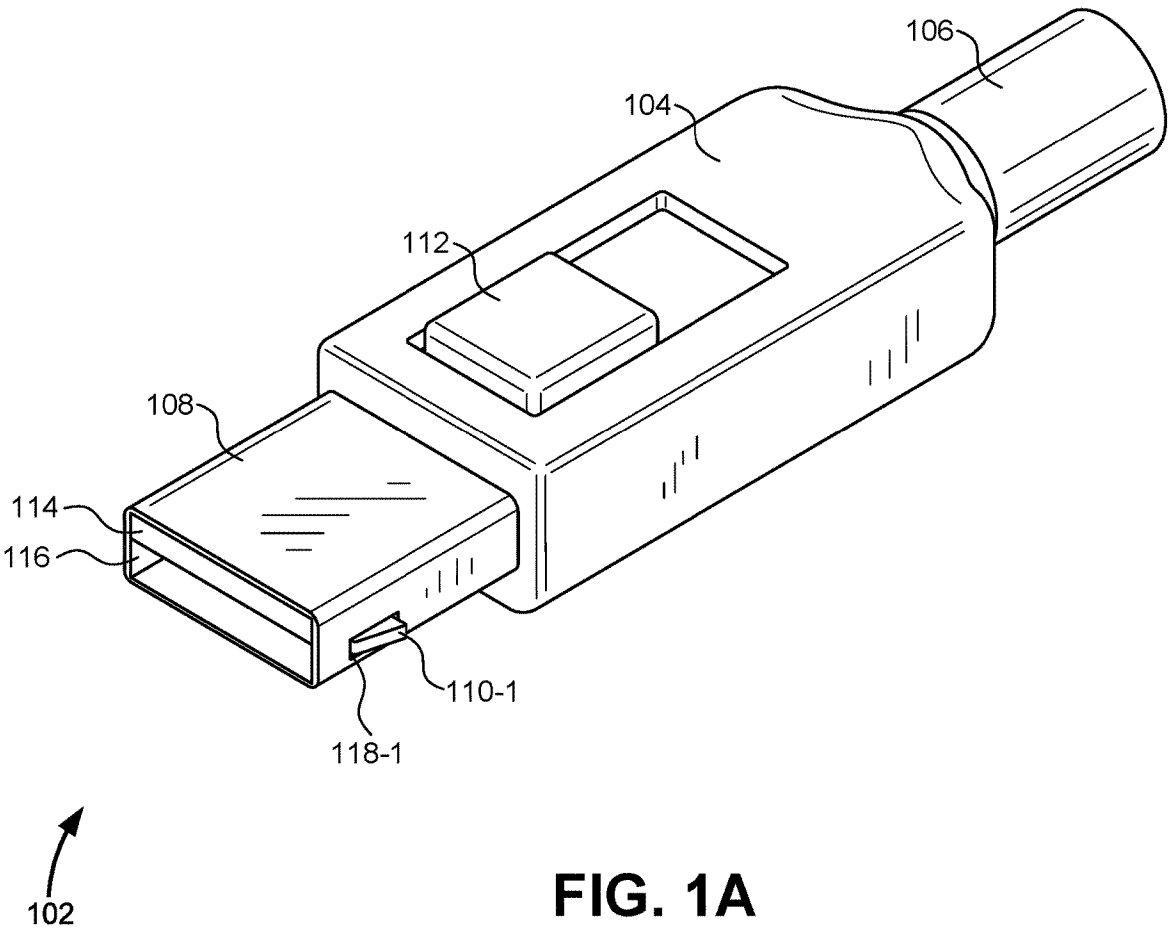
FIGS. 1A-1C illustrate a perspective view, a top view, and a front view, respectively, of an embodiment of a plug assembly.
Figure 1B:
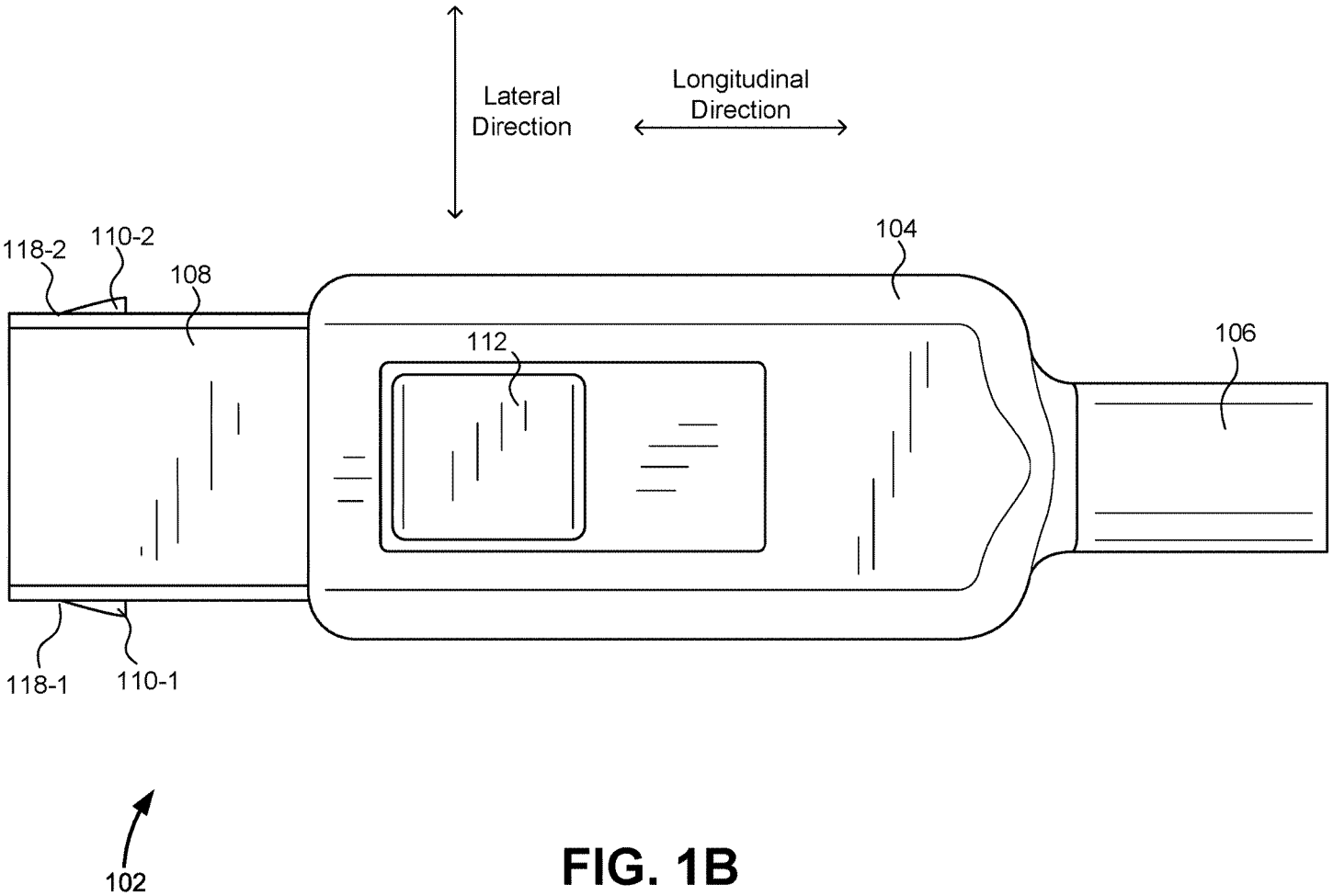
Figure 1C:
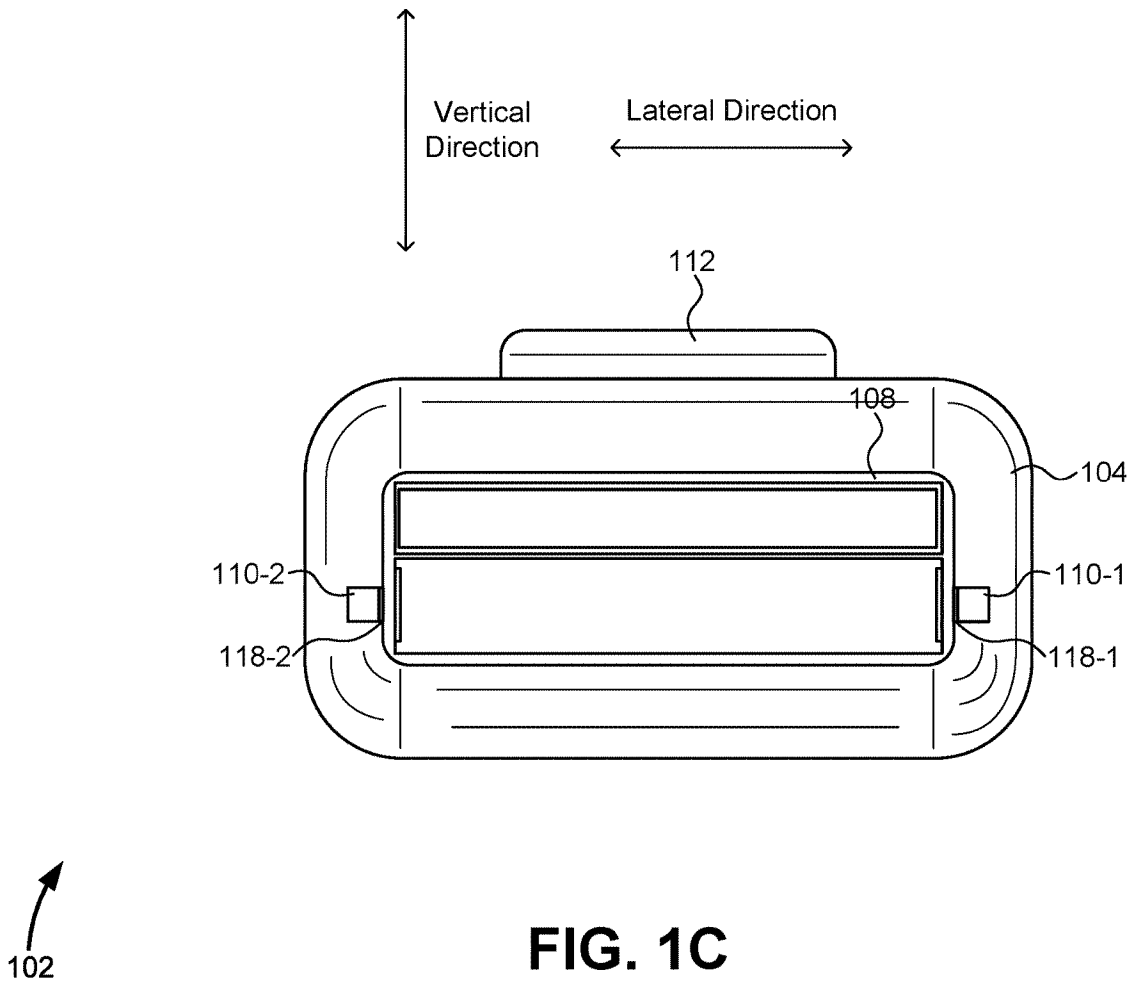

FIGS. 1A-1C illustrate a perspective view, a top view, and a front view, respectively, of an embodiment of a plug assembly 102. As illustrated, plug assembly 102 may include a plug housing 104 coupled to an electrical wire 106 on a first end and to an inserting portion 108 on a second end. In some embodiments, electrical wire 106 may carry four separate conductors corresponding to power, ground, positive data, and negative data. Electrical wire 106 may be coupled to a line power, a computer, a peripheral device, among other possibilities. In some embodiments, inserting portion 108 may include a conductive rectangular shell which surrounds an insulating portion 114 and a hollow portion 116. Insulating portion 114 may include a dielectric material (e.g., plastic, teflon) that occupies a top half of the volume internal to inserting portion 108. Hollow portion 116 may occupy a bottom half of the volume internal to inserting portion 108 and may be configured to receive one or more electrical leads.

In some embodiments, plug assembly 102 includes one or two latches 110 configured to at least partially extend through one or more apertures 118 positioned on one or both sides of inserting portion 108. In a locked position, latches 110 at least partially extend through apertures 118. In an unlocked position, latches 110 are retracted through apertures 118 such that latches 110 are either flush with apertures 118 (i.e., the sides of inserting portion 108) or do not intersect with apertures 118. Plug assembly 102 may switch between the locked and unlocked position by moving latch release 112 in the longitudinal direction. For example, latches 110 may be coupled on one end to latch release 112 such that moving latch release 112 in a first longitudinal direction (to the right in reference to FIG. 1B) causes latches 110 to at least partially move in the first longitudinal direction, and moving latch release 112 in a second longitudinal direction (to the left in reference to FIG. 1B) causes latches 110 to at least partially move in the second longitudinal direction. In some instances, moving latch release 112 in the second longitudinal direction causes latches to move inward in the lateral direction such that latches 110 become flush with apertures 118 or do not intersect with apertures 118.

In some embodiments, latches 110 are shaped and configured such that when a receptacle assembly not shown) receives plug assembly 102, latches 110 become locked against a surface of the receptacle assembly such that the receptacle assembly and plug assembly 102 cannot be separated from each other without moving latch release 112. In other embodiments, or in the same embodiments, the receptacle assembly becomes automatically locked to plug assembly 102 when plug assembly 102 is inserted into the receptacle assembly. In some embodiments, the receptacle assembly only becomes locked to plug assembly 102 when plug assembly 102 is inserted into the receptacle assembly and the latch release 112 is moved. In some embodiments, latch release 112 must be in a particular position (e.g., forward, middle, rear) for the receptacle assembly to become automatically locked to plug assembly 102.

Figure 2A:
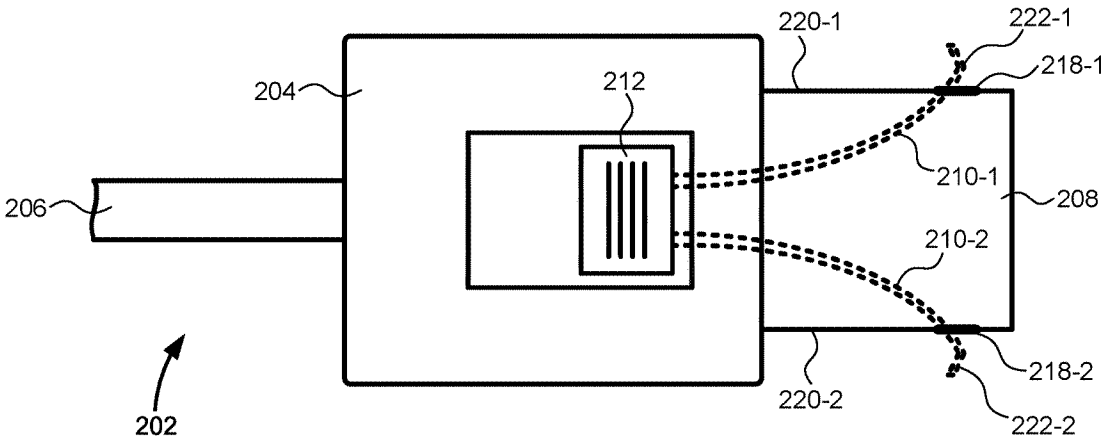
FIG. 2A illustrates a top view of an embodiment of a plug assembly.

FIG. 2A illustrates a top view of an embodiment of a plug assembly 202. One or more components of plug assembly 202 (particularly those having similar numerical reference labels) may be similar to one or more components of plug assembly 102. As illustrated, plug assembly 202 may include a plug housing 204 coupled to an electrical wire 206 on a first end and to an inserting portion 208 on a second end. In some embodiments, electrical wire 206 may carry four separate conductors corresponding to power, ground, positive data, and negative data. Electrical wire 206 may be coupled to a line power, a computer, a peripheral device, among other possibilities. In some embodiments, inserting portion 208 may include a conductive rectangular shell which surrounds an insulating portion and a hollow portion. The insulating portion may include a dielectric material (e.g., plastic, teflon) that occupies a top half of the volume internal to inserting portion 208 and the hollow portion may occupy a bottom half of the volume internal to inserting portion 208 and may be configured to receive one or more electrical leads.

In some embodiments, plug assembly 202 includes one or two latches 210 configured to at least partially extend through one or more apertures 218 positioned on one or both sides of inserting portion 208. Specifically, a first latch 210-1 is configured to at least partially extend through a first aperture 218-1 positioned on a first lateral side 220-1 of inserting portion 208, and a second latch 210-2 is configured to at least partially extend through a second aperture 218-2 positioned on a second lateral side 220-2 of inserting portion 208, first lateral side 220-1 being diametrically opposite second lateral side 220-2. Apertures 218 may be rectangular and/or may be shaped based on the structure of latches 210 and, in some embodiments, may have a retractable shutter that opens or closes based on whether latches 210 are at least partially extended through apertures 218.

In some embodiments, each of latches 210 may be elongated and may be coupled to latch release 212. Latches 210 may extend at least partially in a first longitudinal direction (to the right in reference to FIG. 2A) from latch release 212, and may extend at least partially in an outward lateral direction (in reference to FIG. 2A, upward for first latch 210-1 and downward for second latch 210-2) toward and/or through apertures 218. In some embodiments, latches 210 may each flex in the outward lateral direction such that alignment of latches 210 with apertures 218 in the longitudinal direction causes latches 210 to extend at least partially through apertures 218.

Figure 2B:
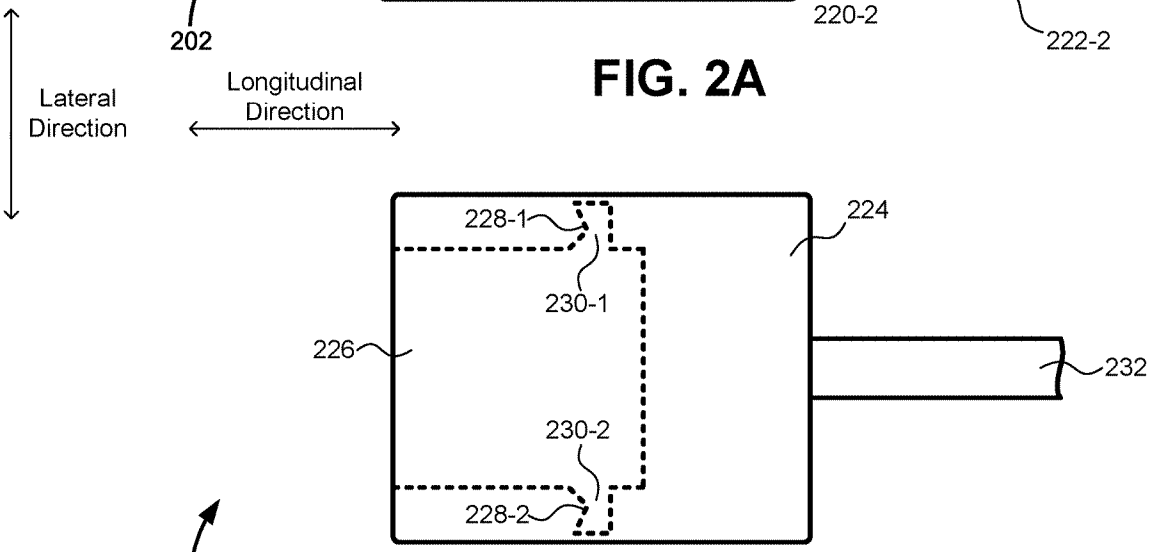
FIG. 2B illustrates a top view of an embodiment of a receptacle assembly.

FIG. 2B illustrates a top view of an embodiment of a receptacle assembly 204. Receptacle assembly 204 may be configured to at least partially receive plug assembly 202 to form an electrical connector assembly 200. As illustrated, receptacle assembly 204 may include a receptacle housing 224 coupled to an electrical wire 232 on a first end and may form a cavity 226 on a second end. Cavity 226 may be hollow and may be structured so as to receive inserting portion 208 of plug assembly 202. In some embodiments, receptacle assembly 204 includes locking portions 230 configured to receive latches 210. Specifically, a first locking portion 230-1 may be configured to receive first latch 210-1 and second locking portion 230-2 may be configured to receive second latch 210-2 when latch release 212 is moved in the first longitudinal direction. In some embodiments, latches 210 may include hooked portions 222 configured to interface with notches 228 when latch release 212 is moved in the first longitudinal direction. Notches 228 may extend (or point) in the first longitudinal direction such that hooked portions 222 may wrap around notches 228 when latch release 212 is moved in the first longitudinal direction.

In some embodiments, first notch 228-1 is defined by a first flat side and a second flat side, the first flat side and the second flat side forming an angle with respect to each other. In various embodiments, the angle may be less than 90 degrees, approximately 90 degrees, or greater than 90 degrees. In one particular embodiment, the angle formed by the first flat side and the second flat side is approximately 120 degrees. Similarly, in some embodiments, second notch 228-2 is defined by a third flat side and a fourth flat side, the third flat side and the fourth flat side forming an angle with respect to each other. In various embodiments, the angle may be less than 90 degrees, approximately 90 degrees, or greater than 90 degrees. In one particular embodiment, the angle formed by the third flat side and the fourth flat side is approximately 120 degrees.

Figure 2C:
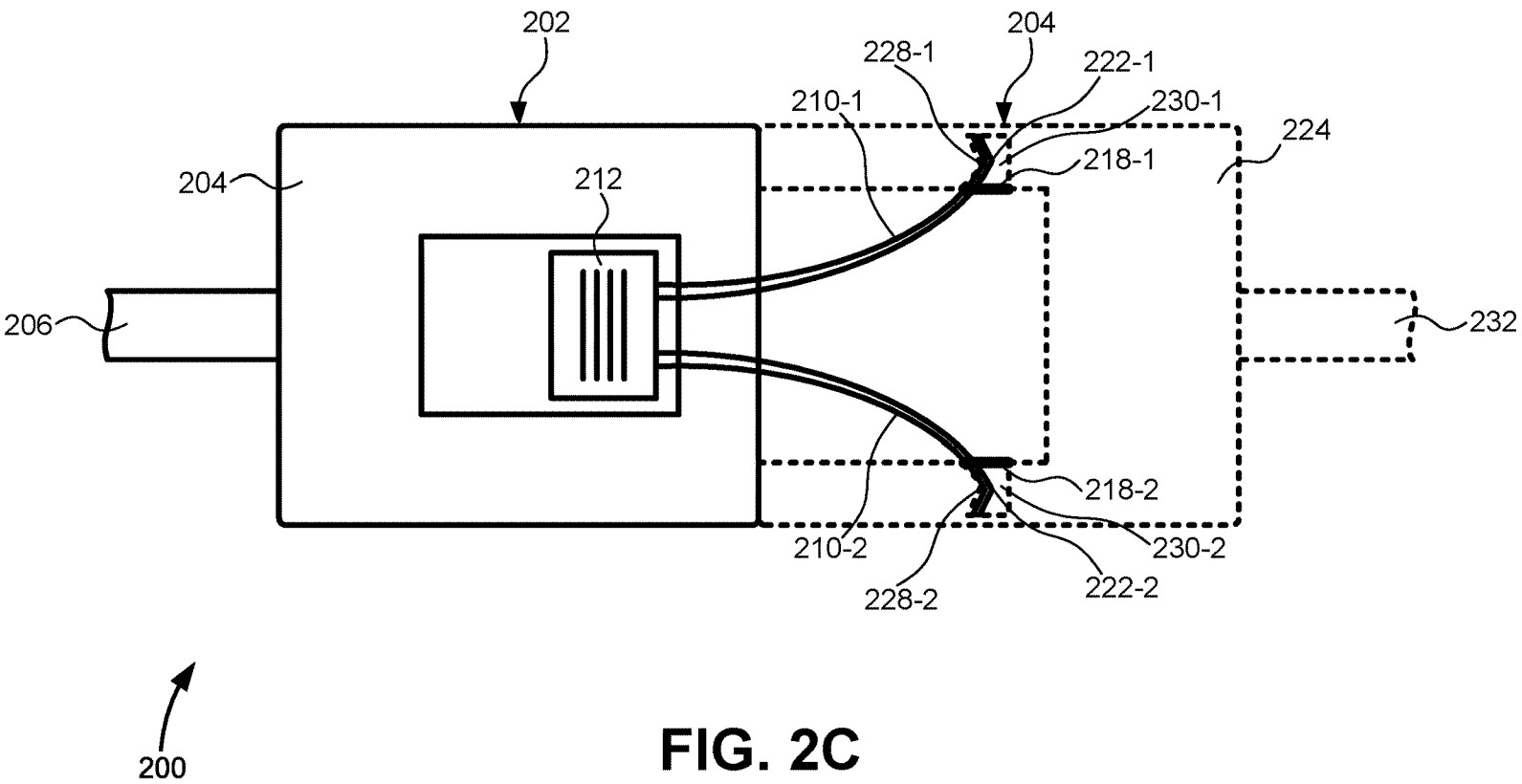
FIG. 2C illustrates a top view of an embodiment of an electrical connector assembly.

FIG. 2C illustrates a top view of an embodiment of electrical connector assembly 200. As illustrated, when latch release 212 is moved in the first longitudinal direction, first latch 210-1 moves at least partially in the first longitudinal direction until first hooked portion 222-1 of first latch 210-1 becomes aligned with first aperture 218-1 in the longitudinal direction. Because first latch 210-1 is flexed in the outward lateral direction, first hooked portion 222-1 passes through first aperture 218-1 and wraps around first notch 228-1 and interfaces with first notch 228-1. First locking portion 230-1 is shaped with sufficient depth in the first longitudinal direction such that the distal end of first latch 210-1 is able to pass through first aperture 218-1, wrap around first notch 228-1, and interface with first notch 228-1 without being impeded by receptacle housing 224. In some embodiments, first notch 228-1 includes a sensor that activates in response to pressure applied to the sensor in the second longitudinal direction. In one specific embodiment, first latch 210-1 and first notch 228-1 are both conductors that, when latch release 212 is moved in the first longitudinal direction, form a conductive path between plug assembly 202 and receptacle assembly 204. In one implementation, the positive data signal carried by electrical wire 206 is routed through first latch 210-1 and first notch 228-1 to electrical wire 232.

Similarly, when latch release 212 is moved in the second longitudinal direction, second latch 210-2 moves at least partially in the first longitudinal direction until second hooked portion 222-2 of second latch 210-2 becomes aligned with second aperture 218-2 in the longitudinal direction. Because second latch 210-2 is flexed in the outward lateral direction, second hooked portion 222-2 passes through second aperture 218-2 and wraps around second notch 228-2 and interfaces with second notch 228-2. Second locking portion 230-2 is shaped with sufficient depth in the first longitudinal direction such that the distal end of second latch 210-2 is able to pass through second aperture 218-2, wrap around second notch 228-2, and interface with second notch 228-2 without being impeded by receptacle housing 224. In some embodiments, second notch 228-2 includes a sensor that activates in response to pressure applied to the sensor in the second longitudinal direction. In one specific embodiment, second latch 210-2 and second notch 228-2 are both conductors that, when latch release 212 is moved in the first longitudinal direction, form a conductive path between plug assembly 202 and receptacle assembly 204. In one implementation, the negative data signal carried by electrical wire 206 is routed through second latch 210-2 and second notch 228-2 to electrical wire 232.

In this manner, latch release 212 may be moved into a locked position such that movement of plug assembly 202 in the second longitudinal or movement of receptacle assembly 204 in the first longitudinal direction does not cause separation of plug assembly 202 and receptacle assembly 204 due to the interfaces formed by hooked portions 222 and notches 228. In some embodiments, hooked portions 222 and notches 228 are made from materials sufficiently strong to withstand ordinary forces of separation made by a user of electrical connector assembly 200. In some embodiments, prevention of separation of plug assembly 202 and receptacle assembly 204 may be accomplished at least in part by hooked portions 222 pointing at least partially in the second longitudinal direction when latch release 212 is moved in the locked position.

Figure 3A:
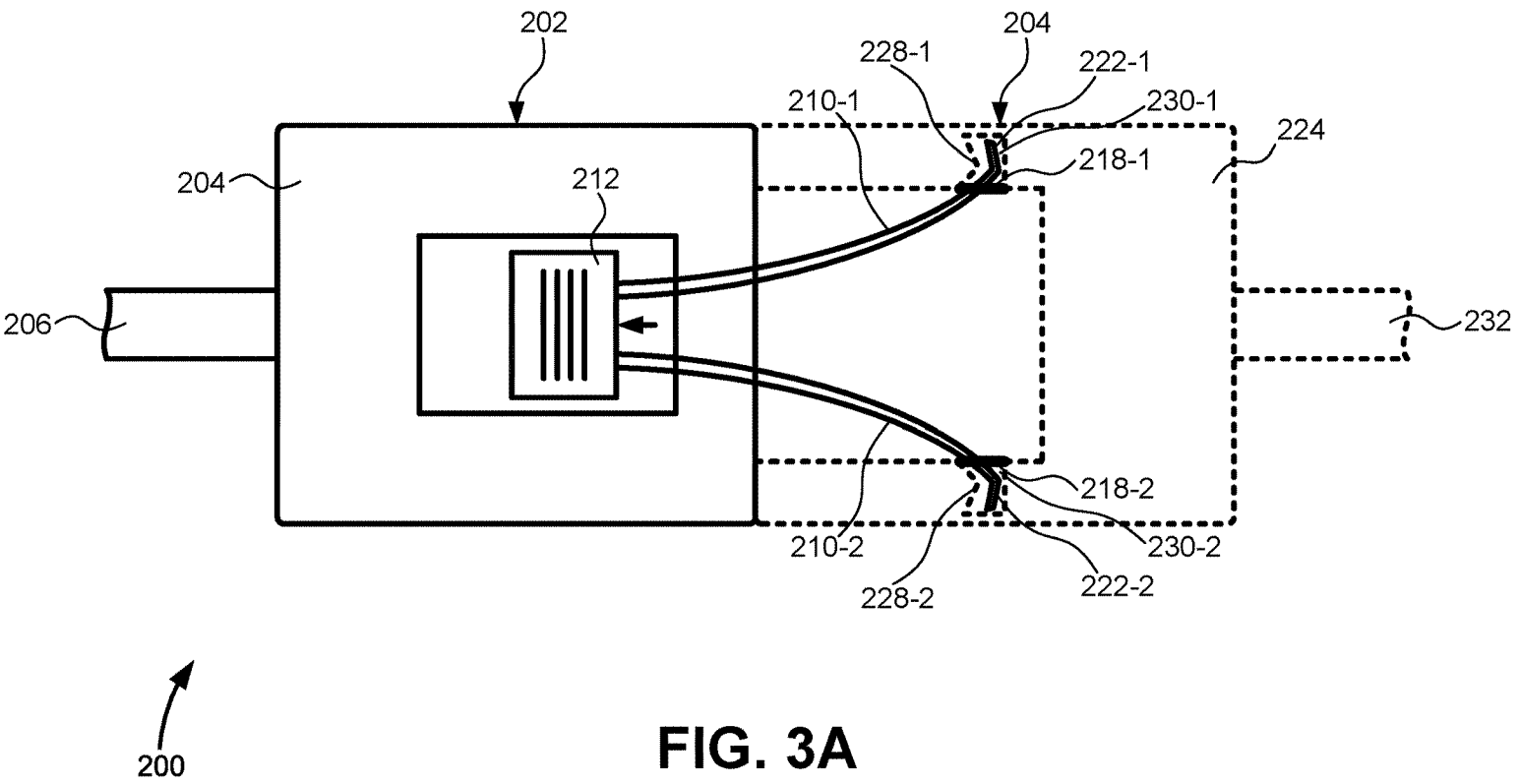
FIGS. 3A and 3B illustrate front views of an embodiment of an electrical connector assembly in which a latch release is moved.
Figure 3B:
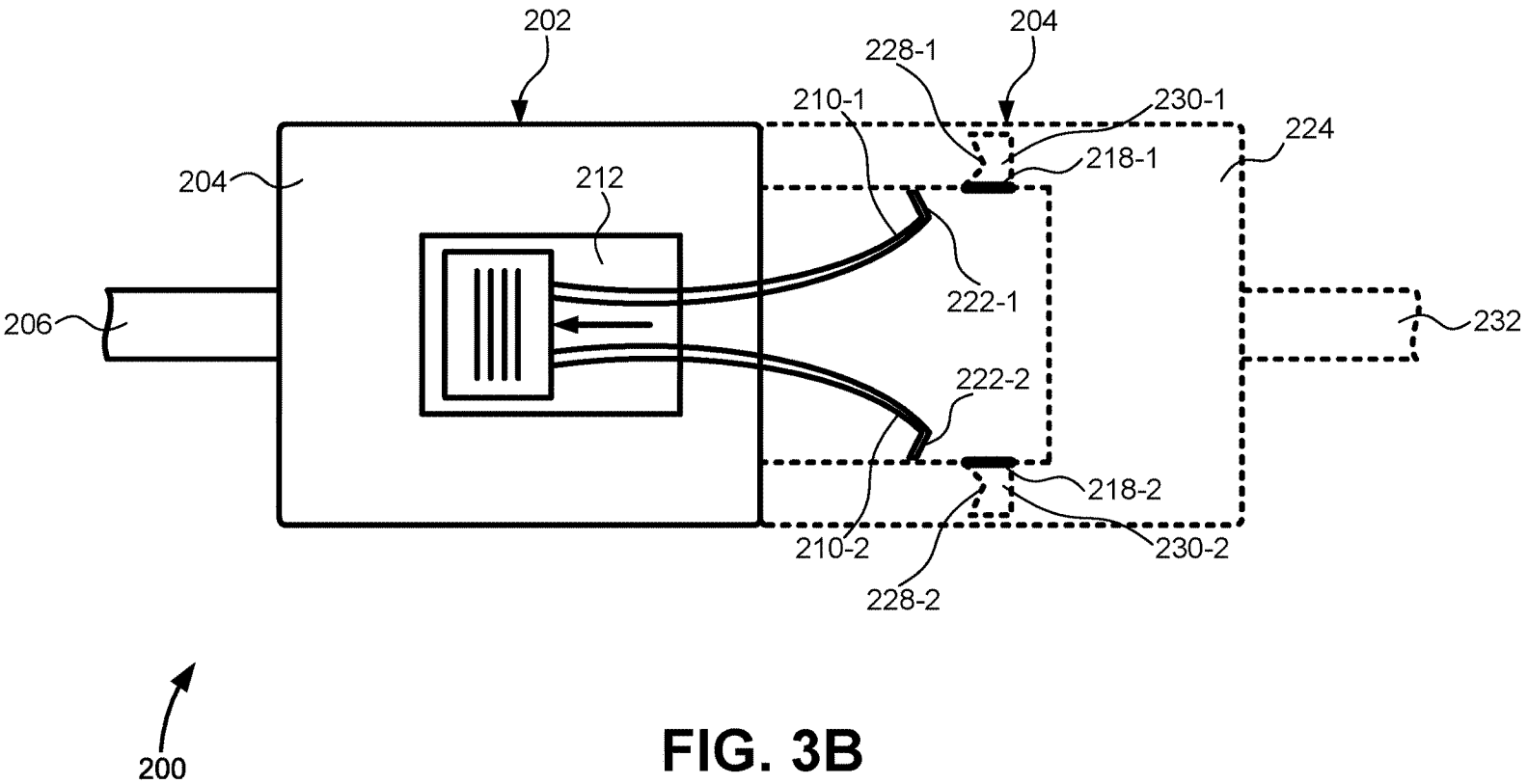

FIGS. 3A and 3B illustrate front views of an embodiment of electrical connector assembly 200 in which latch release 212 is moved in the second longitudinal direction (i.e., from a locked position into an unlocked position). In reference to FIG. 3A, when latch release 212 begins to move in the second longitudinal direction, first latch 210-1 is caused to bend against first aperture 218-1 and second latch 210-2 is caused to bend against second aperture 218-2, causing first hooked portion 222-1 to decouple from first notch 228-1 and second hooked portion 222-2 to decouple from second notch 228-2. In reference to FIG. 3B, when latch release 212 is moved further in the second longitudinal direction, first latch 210-1 is retracted from first aperture 218-1 and becomes unaligned with first aperture 218-1, and similarly, second latch 210-2 is retracted from second aperture 218-2 and becomes unaligned with second aperture 218-2. Latches 210 are then flexed in the outward lateral direction against an interior wall of inserting portion 208.

Figure 4:
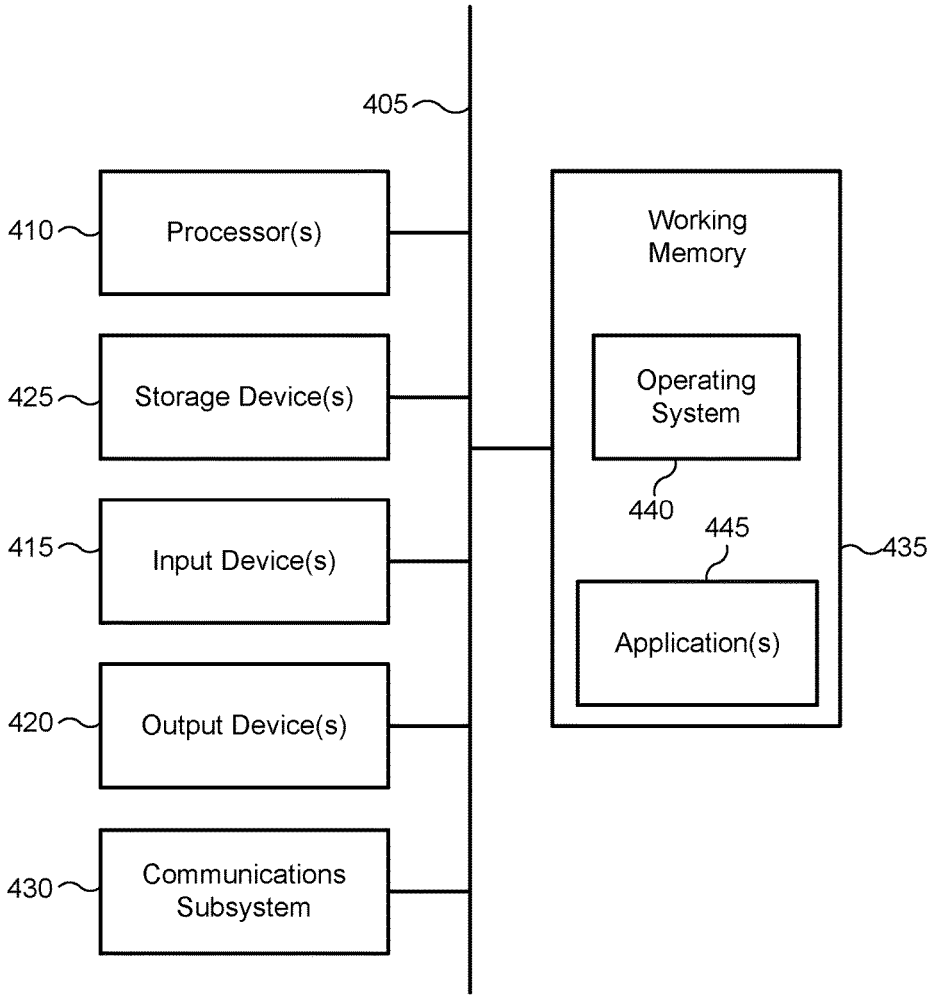
FIG. 4 illustrates a computer system that may utilize an electrical connector assembly.

FIG. 4 illustrates a computer system 400 that may utilize electrical connector assembly 200 or any assembly described previously. Computer system 400 is shown comprising hardware elements that can be electrically coupled via a bus 405, or may otherwise be in communication, as appropriate. The hardware elements may include one or more processors 410, including without limitation one or more general-purpose processors and/or one or more special-purpose processors such as digital signal processing chips, graphics acceleration processors, and/or the like; one or more input devices 415, which can include without limitation a mouse, a keyboard, a camera, and/or the like; and one or more output devices 420, which can include without limitation a display device, a printer, and/or the like.

Computer system 400 may further include and/or be in communication with one or more non-transitory storage devices 425, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable, and/or the like. Such storage devices may be configured to implement any appropriate data stores, including without limitation, various file systems, database structures, and/or the like.

Computer system 400 might also include a communications subsystem 430, which can include without limitation a modem, a network card (wireless or wired), an infrared communication device, a wireless communication device, and/or a chipset such as a Bluetooth™ device, an 802.11 device, a WiFi device, a WiMax device, cellular communication facilities, etc., and/or the like. The communications subsystem 430 may include one or more input and/or output communication interfaces to permit data to be exchanged with a network such as the network described below to name one example, other computer systems, television, and/or any other devices described herein. Depending on the desired functionality and/or other implementation concerns, a portable electronic device or similar device may communicate image and/or other information via the communications subsystem 430. In other embodiments, a portable electronic device, e.g. the first electronic device, may be incorporated into computer system 400, e.g., an electronic device as an input device 415. In some embodiments, computer system 400 will further comprise a working memory 435, which can include a RAM or ROM device, as described above.

Computer system 400 also can include software elements, shown as being currently located within the working memory 435, including an operating system 440, device drivers, executable libraries, and/or other code, such as one or more application programs 445, which may comprise computer programs provided by various embodiments, and/or may be designed to implement methods, and/or configure systems, provided by other embodiments, as described herein. Merely by way of example, one or more procedures described with respect to the methods discussed above, such as those described in relation to FIG. 4, might be implemented as code and/or instructions executable by a computer and/or a processor within a computer; in an aspect, then, such code and/or instructions can be used to configure and/or adapt a general purpose computer or other device to perform one or more operations in accordance with the described methods.

A set of these instructions and/or code may be stored on a non-transitory computer-readable storage medium, such as the storage device(s) 425 described above. In some cases, the storage medium might be incorporated within a computer system, such as computer system 400. In other embodiments, the storage medium might be separate from a computer system e.g., a removable medium, such as a compact disc, and/or provided in an installation package, such that the storage medium can be used to program, configure, and/or adapt a general purpose computer with the instructions/code stored thereon. These instructions might take the form of executable code, which is executable by computer system 400 and/or might take the form of source and/or installable code, which, upon compilation and/or installation on computer system 400 e.g., using any of a variety of generally available compilers, installation programs, compression/decompression utilities, etc., then takes the form of executable code.

It will be apparent to those skilled in the art that substantial variations may be made in accordance with specific requirements. For example, customized hardware might also be used, and/or particular elements might be implemented in hardware, software including portable software, such as applets, etc., or both. Further, connection to other computing devices such as network input/output devices may be employed.

As mentioned above, in one aspect, some embodiments may employ a computer system such as computer system 400 to perform methods in accordance with various embodiments of the technology. According to a set of embodiments, some or all of the procedures of such methods are performed by computer system 400 in response to processor 410 executing one or more sequences of one or more instructions, which might be incorporated into the operating system 440 and/or other code, such as an application program 445, contained in the working memory 435. Such instructions may be read into the working memory 435 from another computer-readable medium, such as one or more of the storage device(s) 425. Merely by way of example, execution of the sequences of instructions contained in the working memory 435 might cause the processor(s) 410 to perform one or more procedures of the methods described herein. Additionally or alternatively, portions of the methods described herein may be executed through specialized hardware.

The terms "machine-readable medium" and "computer-readable medium," as used herein, refer to any medium that participates in providing data that causes a machine to operate in a specific fashion. In an embodiment implemented using computer system 400, various computer-readable media might be involved in providing instructions/code to processor(s) 410 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the storage device(s) 425. Volatile media include, without limitation, dynamic memory, such as the working memory 435.

Common forms of physical and/or tangible computer-readable media include, for example, a floppy disk, a flexible disk, hard disk, magnetic tape, or any other magnetic medium, a CD-ROM, any other optical medium, punch-cards, papertape, any other physical medium with patterns of holes, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 410 for execution. Merely by way of example, the instructions may initially be carried on a magnetic disk and/or optical disc of a remote computer. A remote computer might load the instructions into its dynamic memory and send the instructions as signals over a transmission medium to be received and/or executed by computer system 400.

The communications subsystem 430 and/or components thereof generally will receive signals, and the bus 405 then might carry the signals and/or the data, instructions, etc. carried by the signals to the working memory 435, from which the processor(s) 410 retrieves and executes the instructions. The instructions received by the working memory 435 may optionally be stored on a non-transitory storage device 425 either before or after execution by the processor(s) 410.

As used herein and in the appended claims, the singular forms "a", "an", and "the" include plural references unless the context clearly dictates otherwise. Thus, for example, reference to "a user" includes a plurality of such users, and reference to "the processor" includes reference to one or more processors and equivalents thereof known to those skilled in the art, and so forth.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

What is claimed is:

1. An electrical connector assembly comprising:

a plug assembly comprising:

a plug housing coupled to an electrical wire on a first end, the plug housing including a latch release configured to slide in both a first longitudinal direction and a second longitudinal direction with respect to the plug assembly, the latch release being physically accessible to a user;

an inserting portion coupled to a second end of the plug housing, the inserting portion comprising;

a first aperture positioned on a first lateral side of the inserting portion; and a second aperture positioned on a second lateral side of the inserting portion, the second lateral side being diametrically opposite the first lateral side;

a first latch being elongated, coupled to the latch release, and at least partially extending in the first longitudinal direction through an interior of the inserting portion; and a second latch being elongated, coupled to the latch release, and at least partially extending in the first longitudinal direction through the interior of the inserting portion; and a receptacle assembly configured to at least partially receive the plug assembly, the receptacle assembly comprising:

a receptacle housing having a cavity for receiving the inserting portion;

a first locking portion for receiving the first latch, wherein the first locking portion is defined by a first notch extending in the first longitudinal direction; and a second locking portion for receiving the second latch, wherein the second locking portion is defined by a second notch extending in the first longitudinal direction;

wherein moving the latch release in the first longitudinal direction causes a distal end of the first latch to pass through the first aperture enter the first locking portion, and interface with the first notch, and a distal end of the second latch to pass through the second aperture, enter the second locking portion, and interface with the second notch;

wherein moving the latch release in the second longitudinal direction causes the distal end of the first latch to pass through the first aperture and exit the first locking portion, and the distal end of the second latch to pass through the second aperture and exit the second locking portion.

2. The electrical connector assembly of claim 1, wherein:

the distal end of the first latch includes a first hooked portion that points at least partially in the second longitudinal direction; and the distal end of the second latch includes a second hooked portion that points at least partially in the second longitudinal direction.

3. The electrical connector assembly of claim 2, wherein:

the first notch is configured to interface with the first hooked portion when the latch release is moved in the first longitudinal direction; and the second notch is configured to interface with the second hooked portion when the latch release is moved in the first longitudinal direction.

4. The electrical connector assembly of claim 1, wherein:

the distal end of the first latch includes a first hooked portion that points in a first lateral direction; and the distal end of the second latch includes a second hooked portion that points in a second lateral direction, the second lateral direction being diametrically opposite the first lateral direction.

5. The electrical connector assembly of claim 4, wherein:

the first notch is defined by a first flat side and a second flat side, wherein the first hooked portion is configured to interface with the first flat side and the second flat side when the latch release is moved in the first longitudinal direction; and the second notch is defined by a third flat side and a fourth flat side, wherein the second hooked portion is configured to interface with the third flat side and the fourth flat side when the latch release is moved in the first longitudinal direction.

6. The electrical connector assembly of claim 1, wherein the first latch and the second latch are flexible.

7. The electrical connector assembly of claim 6, wherein moving the latch release in the second longitudinal direction causes the first latch to bend against the first aperture and the second latch to bend against the second aperture.

8. The electrical connector assembly of claim 1, wherein the first latch and the second latch are made from a non-conductive material.

* * * * *